US005678653A

United States Patent [19]

Clinch

[11] Patent Number: 5,678,653

[45] Date of Patent: Oct. 21, 1997

[54] WALLBOARD HANGING SCAFFOLDING SYSTEM

[76] Inventor: Floyd G. Clinch, 465 Castle Rd., Naples, Fla. 33999

[21] Appl. No.: 394,732

[22] Filed: Feb. 27, 1995

[51] Int. Cl.[6] ..... E04G 1/00

[52] U.S. Cl. ..... 182/119; 182/118

[58] Field of Search ..... 182/117, 118, 182/119, 129, 179

[56] References Cited

U.S. PATENT DOCUMENTS

| | | | |
|---|---|---|---|
| 682,783 | 9/1901 | Brooks | 182/118 |
| 982,083 | 1/1911 | McGhan | 182/118 |
| 1,047,251 | 12/1912 | Larson | 182/129 |
| 2,446,005 | 7/1948 | Hartmann | 182/179 |
| 2,966,957 | 1/1961 | Ireland | 182/117 |
| 3,108,657 | 10/1963 | Carlson | 182/179 |
| 4,083,427 | 4/1978 | Box | 182/118 |
| 4,262,774 | 4/1981 | Chez | 182/119 |

FOREIGN PATENT DOCUMENTS

| | | | |
|---|---|---|---|
| 843154 | 7/1949 | Germany | 182/119 |

*Primary Examiner*—Terry Lee Melius
*Assistant Examiner*—Joanne C. Downs
*Attorney, Agent, or Firm*—Oldham & Oldham Co., L.P.A.

[57] ABSTRACT

A scaffolding system for holding and hanging wallboard in an overhead orientation while using only a mechanic and one helper is disclosed. The invention comprises a plurality of braces in a vertical, opposed, parallel relationship, having paired upstanding side members for maintaining a stable, untippable status. Each side member further has a recess on a lower end adapted for receiving a wheel for mobility. A plurality of rigid sections are horizontally disposed within the braces and form a platform for the mechanic and helper to stand on. A plurality of ladders urge the helper to mount one of the side braces after the wallboard is resting on a plurality of pintles against the side members. A plurality of wheels provide mobility for the system without disassembly of the system as the wallboard is installed overhead.

4 Claims, 4 Drawing Sheets

WALLBOARD HANGING SCAFFOLDING SYSTEM

BACKGROUND OF THE INVENTION

1. Field of the Invention

The present invention relates to a mobile scaffolding system, and in particular, a mobile scaffolding system for use by sheetrockers for safely handling and installing four-foot by twelve-foot sheets of wallboard.

2. Description of the Background Art

Throughout the United States steps are being taken to improve wallboard hanging scaffolding systems.

The industry has a piecework payment system in which the sheetrock mechanic and helper are paid on a unit basis for each and every sheet of wallboard that is fixed to the wall or ceiling of the building that they are working on. The trend towards higher ceilings has increased the labor required to install sheetrock at high elevations and in particular, ceilings because the standard four-foot by twelve-foot sheets cannot be adequately handled by only two people. This has necessitated a splitting of the funds among three individuals versus two and has forced each sheetrock mechanic to install more wallboard to make the same amount of money on a daily basis.

This invention will eliminate the need for the third person when handling and installing four-foot by twelve-foot sheets of wallboard at elevations typically found in commercial, institutional and residential construction. The system will allow the two person crew to hoist and hold multiple sheets of four-foot by twelve-foot wallboard and also allow the two person crew to move the entire scaffolding system from room to room without having to dismantle the system as is the case today. These unique features of the invention will increase the productivity of the two person sheetrock crew by eliminating the dismantling and reassembly of the scaffolding system as each room in a building is completed as is the case today. Further, the ability to hold a plurality of four-foot by twelve-foot wallboard sheets on the system at an elevated height will eliminate totally the need for the third crewperson.

The invention has trapezoidal shaped sidemembers which keeps the invention in an untippable status even when it is elevated to the full twelve-foot platform height that is typically required to install sheetrock in an overhead position at ceiling heights of eighteen-foot which is commonly found in institutional and office work, and more commonly in residential work.

U.S. Pat. No. 3,642,150 issued to Zizak discloses a sheetrock scaffolding having an elongated member with a brace and one extremity and pivoting means to enable an individual sheetrocker to mount and pivot a sheet of wallboard to an overhead position for nailing.

U.S. Pat. No. 930,188 issued to Kearney discloses a paper hangers table or platform having two extensible, joinable pieces supported on a pair of trestles for allowing the paper hanger to walk freely on the platform and apply paper to the walls.

U.S. Pat. No. 3,235,038 issued to Nesslinger discloses a folding scaffold apparatus having a box like rectangular parallelogram shape. Patent '038 teaches the use of wheels to increase the mobility and has two end frames and side braces with an interposed top brace.

U.S. Pat. No. 3,446,309 issued to Davis et al. discloses a roller mount for ladders to convert a conventional stepladder into a mobile stepladder.

U.S. Pat. No. 3,474,883 issued to Weis discloses a multi-adjustable stepladder for use on a rough or multi-level terrain having individually adjustable main legs to provide a level platform for a person to mount the stepladder.

U.S. Pat. No. 3,568,796 issued to Stanhope discloses an arcuate shaped fruit workers platform for harvesting fruit in orchard settings.

Patent '796 teaches the use of wheels to enhance mobility and teaches a trapezoidal shape to maintain stability.

U.S. Pat. No. 594,674 issued to Bowman teaches the use of a portable stepladder having one leg with wheels for partial mobility.

U.S. Pat. No. 701,532 issued to Bardin discloses a stepladder having a shelf with a plurality of levels for holding materials.

U.S. Pat. No. 5,120,013 issued to Sweeney discloses a ladder shelf assembly for a stepladder having two upright telescoping arms. Patent '013 teaches the use of the platform to hold materials.

U.S. Pat. No. 362,914 issued to Zeigler discloses a trestle apparatus readily connected across a space with boards to form a platform for plasterers and other mechanics to stand thereon while working.

Therefore, it is an object of the present invention to provide a system that allows only a two worker crew to handle and install full twelve-foot lengths of drywall.

It is a further object of the invention to provide a scaffold that will extend to allow the two-person crew to install drywall on ceilings at elevations up to eighteen-foot without having to resort to a second section of scaffolding.

It is yet another object of the invention to provide a platform for the crew that allows the installation of full twelve-foot lengths of drywall without endangering the safety of the crew.

It is still further another object of the invention to provide a system that is mobile and capable of rolling from room to room and increase the productivity of the crew.

It is still yet another object of the invention to provide a system that is collapsible and easily transported from job site to job site.

It is still yet further another object of the invention to provide a system that is easily adjustable for ceiling height installations at an interval of about between six inch intervals.

It is yet another object of the invention to provide a system that is inherently stable, and in particular inherently stable when the system is fully extended for ceilings of eighteen-foot heights.

It is yet another object of the invention to provide a system that can be quickly set up at the job site and broken down after completion of the work.

It is yet another object of the invention to provide support for a plurality of twelve foot sheets of drywall on the scaffold awaiting installation.

It is a final object of the invention to provide mounting means for the crew to scale the scaffolding when the system is in a fully extended position.

It is yet still a final object of the invention to provide a system that will allow a two-man crew to do the work that heretofore required a three-man crew, and in particular handling the standard four-foot by twelve-foot long drywall boards.

A final object of this invention to be specifically enumerated herein is to provide a wallboard hanging scaffolding system in accordance with the proceeding objects and which will conform to conventional forms of manufacture, be of simple construction and easy to use so as to provide a device that would be economically feasible, long lasting and relatively trouble free in operation.

Although there have been many inventions related to wallboard hanging scaffolding system none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a scaffolding system for holding and hanging wallboard in an overhead orientation while using only a mechanic and one helper. The invention has a plurality of braces in a vertical, opposed, parallel relationship. Each brace has paired upstanding side members in a trapezoidal shape for maintaining a stable, untippable status. Each side member further has a recess on a lower end adapted for receiving a wheel that allows mobility, and still further has a pintle attached to an outer edge of the side member that supports a full sheet of wallboard. A platform is provided for the mechanic and helper to stand on.

Ladders are provided to allow the helper to mount one of the side braces after the wallboard is resting on the pintles against the side members. Each ladder has a plurality of elongated hooks adapted for removable engagement with a plurality of horizontally disposed cross members therebetween the upstanding side members. Finally, a plurality of wheels is provided for mobility of the system without disassembly of the system as the wallboard is installed overhead, each wheel being adapted to releasably engage the recess on the lower end of each side member.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings.

FIG. 2 is a top plan view of the platform.

FIG. 3 is a front elevation view of the platform.

FIG. 4 is a rear elevation view of the platform.

FIG. 5 is a left-hand side view of the platform showing the elongated braces.

FIG. 6 is a right-hand edge view of the platform showing the elongated braces.

FIG. 7 is a bottom plan view of the platform in an installed status showing the cross members supporting a wooden plywood sheet and further showing a plurality of slide bars in an interlocking relationship to maintain the platform in the installed status.

FIG. 7A also discloses a tube adapted to receive the slide bar in interlockable communication.

FIG. 8 is a left-hand side elevation view of the side member in the retracted status. FIG. 8 also shows the plurality of pintles attached to the outer surface of the upstanding side member and the ladder in the coupled relationship with the cross braces therebetween.

FIG. 9 is a top plan view of the upstanding side member as disclosed in FIG. 8.

FIG. 10 is a bottom plan view of the upstanding side member as disclosed in FIG. 8.

FIG. 11 is a front elevation view of the invention as disclosed in FIG. 8.

FIG. 12 is a left side elevation view of the side member as disclosed in FIG. 8.

FIG. 13 is a front elevation view of the invention as disclosed in FIG. 12 and discloses a plurality of apertures in a spaced apart relationship to allow the mechanic and helper to set the invention at any desired height.

FIG. 14 is a front elevation view of the removable ladder prior to being coupled to a crossmember of the upstanding side members.

FIG. 15 is a top plan view of the ladder as shown in FIG. 14.

FIG. 16 is a bottom plan view of the ladder as shown in FIG. 14.

FIG. 17 is a right-hand elevation view of the ladder as shown in FIG. 14.

FIG. 18 is a front elevation view of a typical slide bar.

Similar reference characters refer to similar parts throughout the several views of the drawings.

DETAILED DESCRIPTION OF THE PREFERRED EMBODIMENT

The primary components of the invention are the two side braces and a platform which also comes in two pieces. The entire apparatus can be broken down into four components which is really two pieces with mirror images on the opposite hand. It is very effective for sheetrockers for setting up, tearing down and carrying in their trucks between jobs.

A plurality of ladders are disposed on the crossmembers to allow the crew to mount the system when in use and operation. The invention is explained in detail hereinbelow.

The invention 10 gives the sheetrocker standing room along a nine-foot length, and allows the two man crew to install a twelve-foot long wallboard with only eighteen inches of overhang on each end. The crew can easily reach each overhanging edge with installation tools to fasten the sheetrock board safety.

Figure 1:
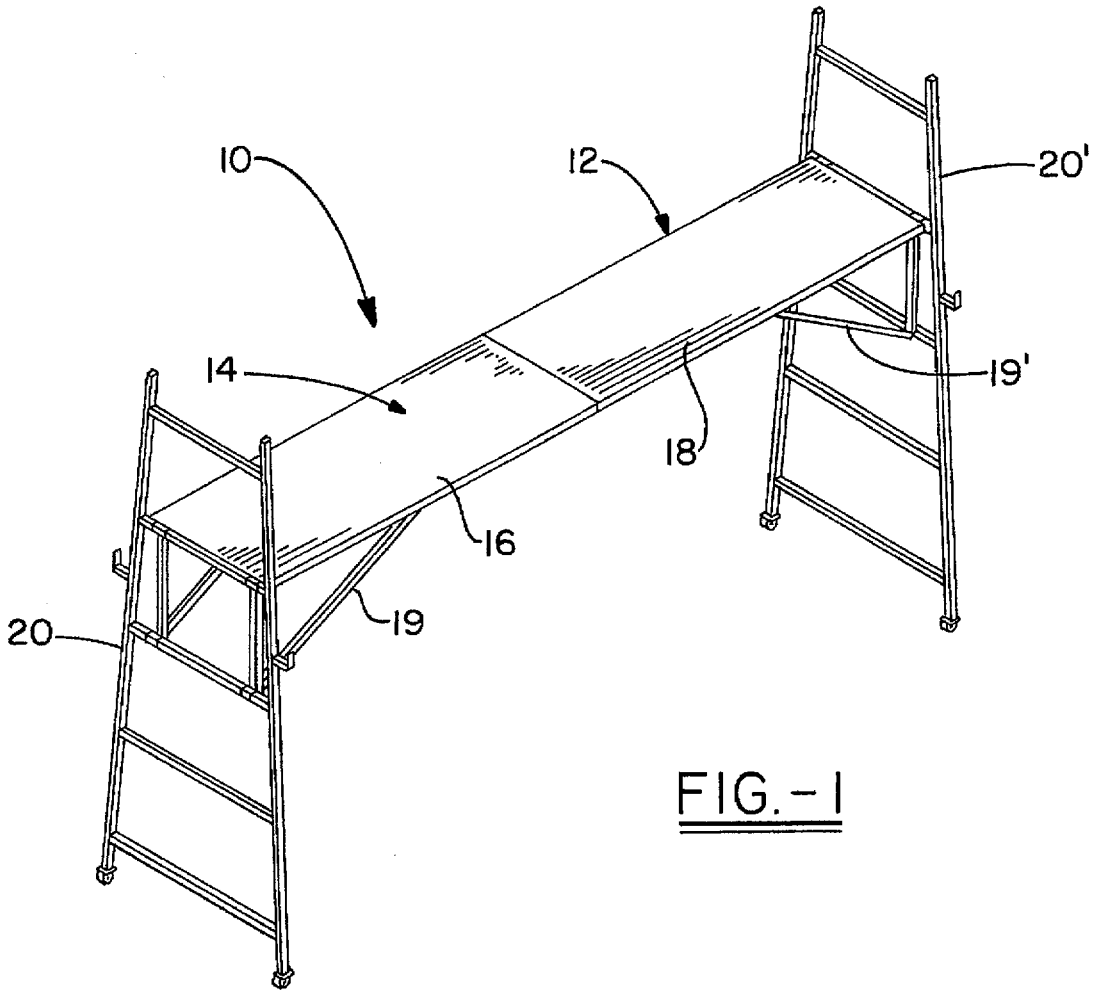
FIG. 1 is a perspective illustration of the invention showing the paired opposed upstanding side members and the platform joined at the center therebetween.
Figure 2:
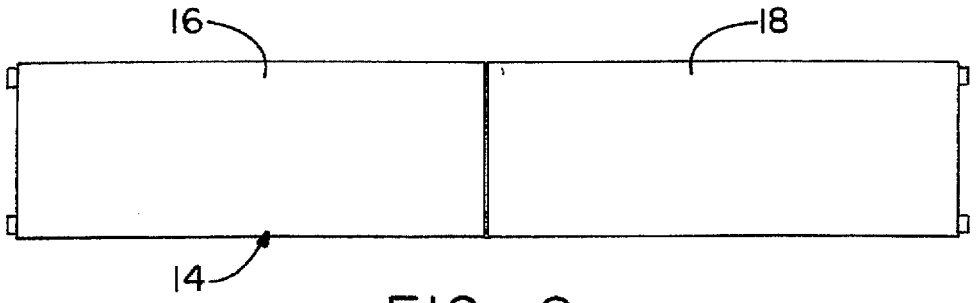
FIGS. 2 through 7 disclose the paired platform portion of the invention.
Figure 3:
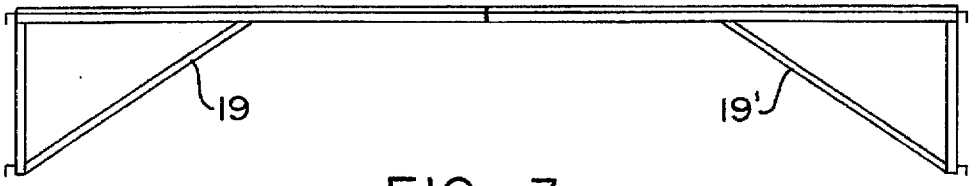
Figure 4:
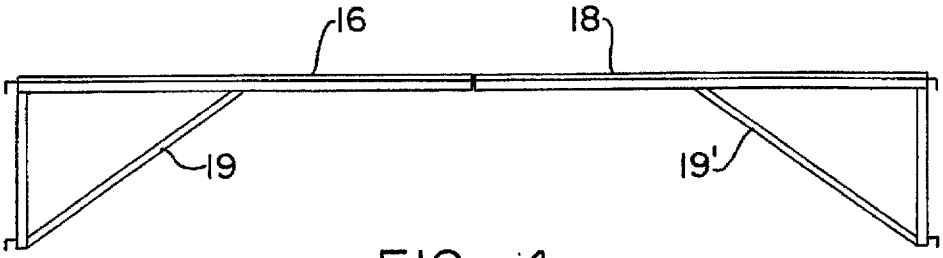
Figure 5:
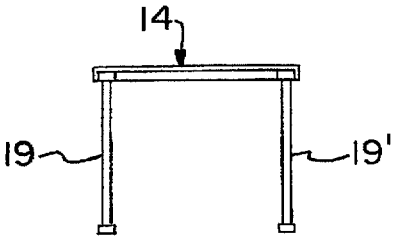
Figure 6:
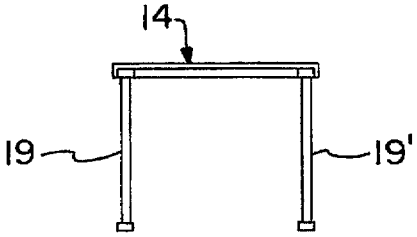
Figure 7:
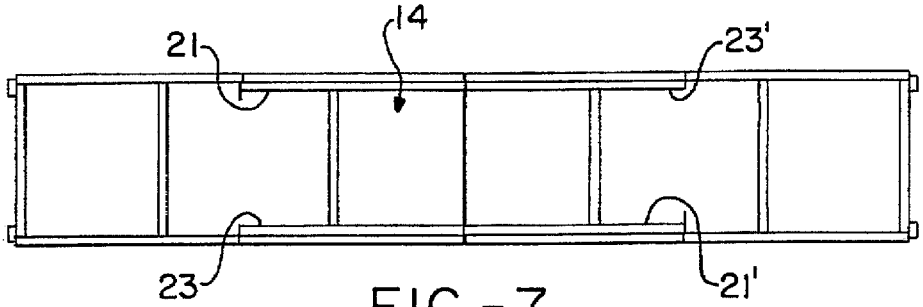
Figure 7A:
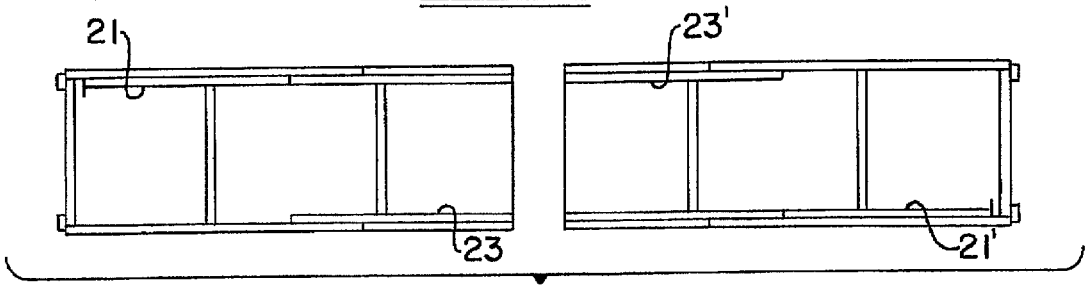
FIG. 7A is a bottom plan view of the platform in the uninstalled status showing the slide bars in a retracted status and the platform being in two pieces in an uncoupled relationship.
Figure 9:
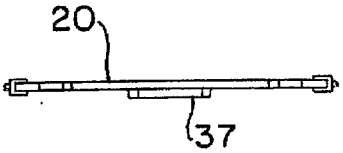
FIGS. 8 through 13 disclose the side member portion of the invention.
Figure 10:
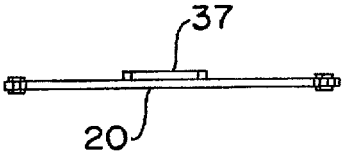
Figure 13:
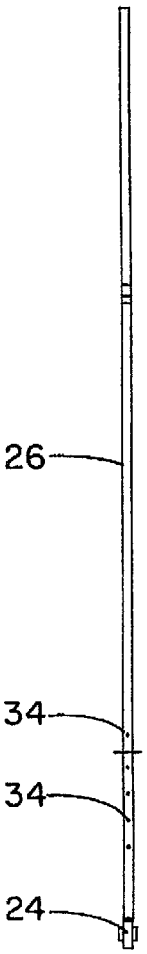
Figure 12:
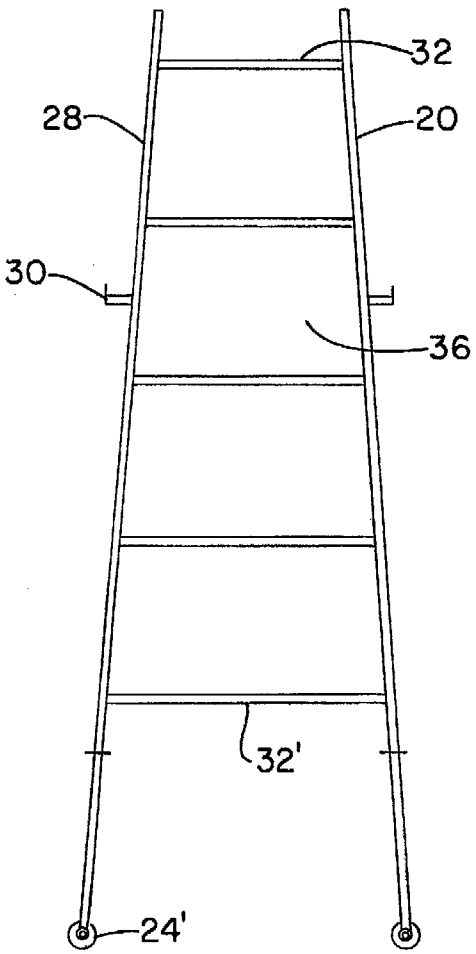
Figure 11:
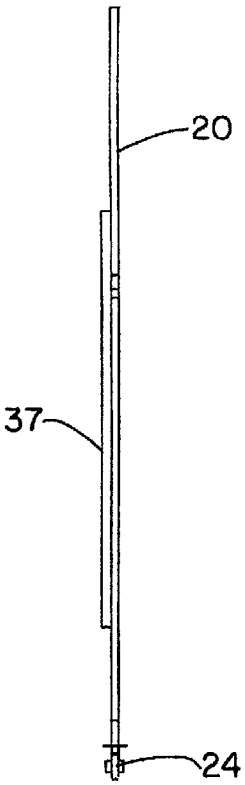
Figure 8:
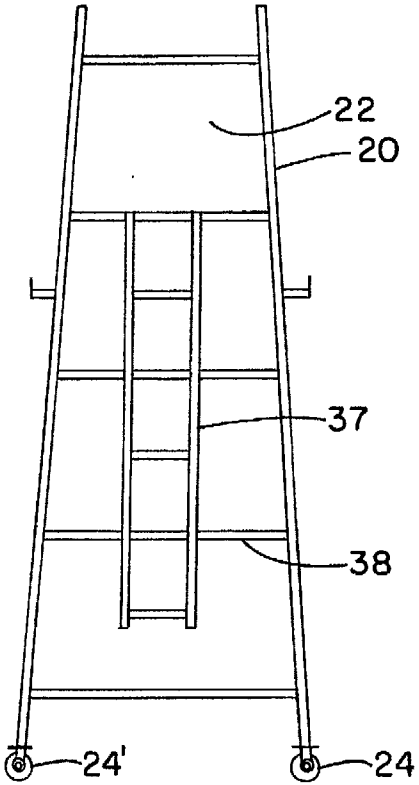
Figure 14:
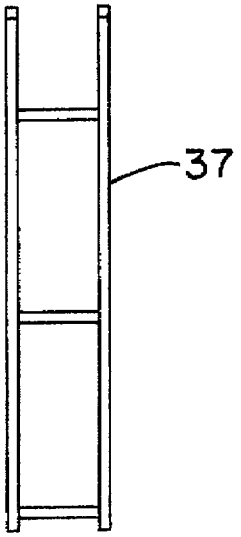
FIGS. 14 through 18 disclose the removable ladder.
Figure 15:
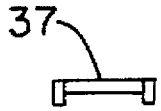
Figure 16:
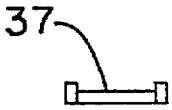
Figure 17:
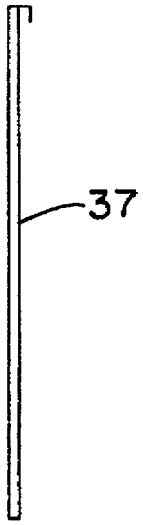
Figure 18:
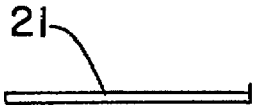

Referring generally to FIG. 1, the scaffold 12 comes with a twenty-four inch wide walking platform 14 which comes in two fifty-four inch long sections 16, 18. The platform can be made from any suitable material, preferably plywood that will support the weight of the two man crew safely. Each section 16 interlocks with the other section 18 forming the platform 14 with an overall length of nine feet. The platform 14 has a plurality of brackets 19, 19' that are secured to a plurality of corner frame braces 20, 20'. Slide bars 21, 21' join section 16 with section 18 to form platform 14. Each slide bar 21 is adapted to interlock with a hollow tube 23 that is disposed on the opposite section 16, 18.

Each corner frame brace 20 is thirty-six inches wide at the bottom and twenty-eight inches wide at the top, thereby forming a trapezoidal crossmember 22 which has inherent stability when the individual sheetrocker is walking on the platform 14 on top of the invention 10. Additionally, each frame brace 20 has a plurality of wheels 24, 24' to enhance mobility for hanging sheetrock in different rooms in a house or in a hallway. Each frame 20 comes with an extension leg 26 which slides into the corner frame brace 20 itself. Twenty-four inches down from the top of the frame 20 on a side 28 is a support pintle 30 which can hold the four by twelve sheets of sheetrock without any external systems from the sheetrock mechanic or the helper. Each frame 20 has a plurality of cross bars 32, 32' that are horizontally disposed on an eighteen-inch on-center basis. The trapezoidal cross-section of the frame brace 20 allows the sheetrockers to elevate the scaffold 12 while still maintaining a safe working environment.

Additionally, each extension leg 26 have a plurality of holes 34, 34' drilled therethrough on a twelve-inch on-center basis and adapted to receive a common nail which allows the sheetrocker to raise or lower the scaffold 12 on a plus or minus six inch interval.

The genius of the invention is the fact that the frame braces 20 have a trapezoidal cross-section so that the center of gravity is always contained within an area 36 of the frame braces 20 which gives it inherently greater stability than the conventional rectangular cross-sectional frames with conventional cross braces. The second advantage is that the frames 20 are extendable on a twelve-inch on-center basis so that the sheetrockers can adjust the scaffolding 12 to any desired height with a plus or minus six inches by merely using a different hole 34, 34' and common nail. The invention 10 will reduce the amount of labor required to set up and break down a scaffold and therefore should be very attractive economically to the construction trades and particularly the sheetrock trade. The third advantage of the invention is the extensibility of the platform 14 to twelve-foot height. Conventional scaffolds are six-foot high which requires the crew to assemble two sections to get a platform twelve-foot high above the ground.

The invention 10 solves the real problem of hanging twelve-foot long wallboard overhead when your scaffold is only six-foot long because you can't get to the outer edges to use the screw gun to nail the scaffolding to the studs. While standard scaffolding is only six-foot long, the invention 10 is nine-foot long to reduce the amount of overhang from three-foot to eighteen inches which is more than adequate for a sheetrocker to support with one hand while he drives the screw nails in with the screw gun in the other hand.

Also, because of the trapezoidal shape of the cross members 22, 22', the board, when it is resting on the pintles 30, 30', does not have to be held by the helper. The center of gravity of the sheetrock board itself is inward and therefore the board is self-supporting which is significant because in a two-man operation the helper has to hold the board precariously while the mechanic has to climb the scaffold 12 and help lift the four-foot by twelve-foot sheet of wallboard overhead so they can apply it to the studs on the ceiling. Also, the scaffold 12 has the plurality of wheels 24, 24' so it is totally mobile and can be moved inside conventional doors because the width is less than a conventional door. It is thirty-eight inches at the base and tapering to twenty-eight inches at the apex of the cross member 22.

Finally, there is a removable ladder 37 that is attached to a lower rung 38 of the corner frame brace 20 for the rockers to use to scale the scaffold 12 when it is in a fully extended position. In effect the platform 14 can extend to twelve-foot off the ground. This is very useful in construction of commercial ceilings and more particular, when you are working in homes where you have twelve, fourteen or even sixteen-foot ceilings. The invention 10 will allow two men to do the work where, heretofore, you needed three people to handle four by twelve boards. Since sheetrock installation is piece work, the economic effect of this invention will revolutionize the installation of sheetrock in the residential construction industry.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed:

1. A scaffolding system for holding and hanging wallboard in an overhead orientation while using only a mechanic and one helper, comprising:

a plurality of braces in a vertical, opposed, parallel relationship, each of said plurality of braces having paired upstanding side members for forming a trapezoidal shape for maintaining a stable, untippable status, each of said paired upstanding side members further having a recess on a lower end adapted for receiving a wheel for urging mobility, and still further having a pintle attached to an outer edge of each of said paired upstanding side members for urging support of a full sheet of wallboard;

a plurality of rigid sections horizontally disposed within said plurality of braces for forming a platform for the mechanic and helper to stand on, each of said plurality of rigid sections being in releasable interlockable contact with and coplanar to another of said plurality of rigid sections and further having a plurality of brackets in removable support communication with one of said plurality of braces;

a plurality of ladders for urging the helper to mount one of said plurality of braces after the wallboard is resting on said pintles against said paired upstanding side members, each of said plurality of ladders further having a plurality of elongated hooks adapted for removable engagement with a plurality of horizontally disposed cross members extending between said paired upstanding side members; and a plurality of wheels for urging mobility of said scaffolding system without disassembly of said scaffolding system as the wallboard is installed overhead, each of said plurality of wheels being adapted to releasably engage said recess on said lower end of each of said paired upstanding side members.

2. The scaffolding system as recited in claim 1, wherein each of said paired upstanding side members further includes a plurality of sections in an extensible nested annular relationship for urging said scaffolding system to maintain any desired elevation for installing the wallboard overhead.

3. The scaffolding system as recited in claim 2, wherein each of said plurality of sections further includes a plurality of apertures in a spaced apart collinear relationship and a plurality of pins, each of said plurality of pins engaging one of said plurality of apertures at a desired height for maintaining said scaffolding system in a stable condition at the desired height.

4. The scaffolding system as recited in claim 1, wherein each of said plurality of rigid sections further includes a slide bar adapted for interlocking communication with a hollow tube disposed on another of said plurality of rigid sections for creating a walking platform.

* * * * *